US008186968B2

(12) United States Patent
Buse et al.

(10) Patent No.: US 8,186,968 B2
(45) Date of Patent: May 29, 2012

(54) COMPRESSOR UNIT INCLUDING A DETECTION DEVICE TO IDENTIFY NON-GASEOUS FLUID IN THE SUCTION LINE

(75) Inventors: Marcel Buse, Enschede (NL); Mark Van Aarsen, Hengelo (NL)

(73) Assignee: Siemens Aktiengesellchaft, Munich (DE)

( * ) Notice: Subject to any disclaimer, the term of this patent is extended or adjusted under 35 U.S.C. 154(b) by 0 days.

(21) Appl. No.: 12/918,394

(22) PCT Filed: Feb. 18, 2009

(86) PCT No.: PCT/EP2009/051919

§ 371 (c)(1),
(2), (4) Date: Aug. 19, 2010

(87) PCT Pub. No.: WO2009/106465

PCT Pub. Date: Sep. 3, 2009

(65) Prior Publication Data

US 2010/0322785 A1 Dec. 23, 2010

(30) Foreign Application Priority Data

Feb. 25, 2008 (EP) ..... 08003399

(51) Int. Cl.
*F04B 49/06* (2006.01)
*F04B 49/00* (2006.01)

(52) U.S. Cl. ..... 417/53; 417/279

(58) Field of Classification Search ..... 417/1, 18, 417/43, 44.1, 53, 53.1, 300, 279; 166/105.5, 166/250.01; 137/197, 565.16
See application file for complete search history.

(56) References Cited

U.S. PATENT DOCUMENTS

| | | | | |
|---|---|---|---|---|
| 3,568,771 | A * | 3/1971 | Vincent et al. | 166/250.15 |
| 4,527,632 | A * | 7/1985 | Chaudot | 166/357 |
| 5,240,380 | A * | 8/1993 | Mabe | 417/43 |
| 5,390,743 | A * | 2/1995 | Giannesini | 166/366 |
| 5,393,202 | A * | 2/1995 | Levallois | 417/19 |
| 5,775,879 | A * | 7/1998 | Durando | 417/45 |
| 5,851,293 | A * | 12/1998 | Lane et al. | 118/715 |
| 6,167,965 | B1 * | 1/2001 | Bearden et al. | 166/250.15 |
| 6,302,653 | B1 * | 10/2001 | Bryant et al. | 417/53 |
| 6,341,615 | B1 * | 1/2002 | Zorich et al. | 137/14 |
| 6,354,318 | B2 * | 3/2002 | Butler | 137/2 |
| 6,773,235 | B2 * | 8/2004 | Poorte et al. | 417/1 |
| 6,783,331 | B2 * | 8/2004 | Lopes et al. | 417/216 |
| 2003/0010502 | A1 * | 1/2003 | Poorte et al. | 166/373 |
| 2004/0245182 | A1 * | 12/2004 | Appleford et al. | 210/739 |
| 2005/0250860 | A1 * | 11/2005 | Appleford et al. | 516/135 |
| 2006/0237195 | A1 * | 10/2006 | Wilde | 166/372 |

FOREIGN PATENT DOCUMENTS

| | | | |
|---|---|---|---|
| GB | 2215408 A | * | 9/1989 |
| WO | WO 0150024 A1 | | 7/2001 |

* cited by examiner

*Primary Examiner* — Charles Freay
*Assistant Examiner* — Alexander Comley

(57) ABSTRACT

A compressor unit including a compressor is provided. The compressor unit includes a suction line and a discharge line, a control unit which controls the compressor and/or adjacent modules. A method to operate a compressor unit is also provided. To avoid any damage caused by non-gaseous fluid amount at least one detection device is disposed in the suction line to identify non-gaseous fluid amounts in the fluid to be compressed before entering the compressor. The detection device is connected to the control unit in a signal transmitting manner.

9 Claims, 1 Drawing Sheet

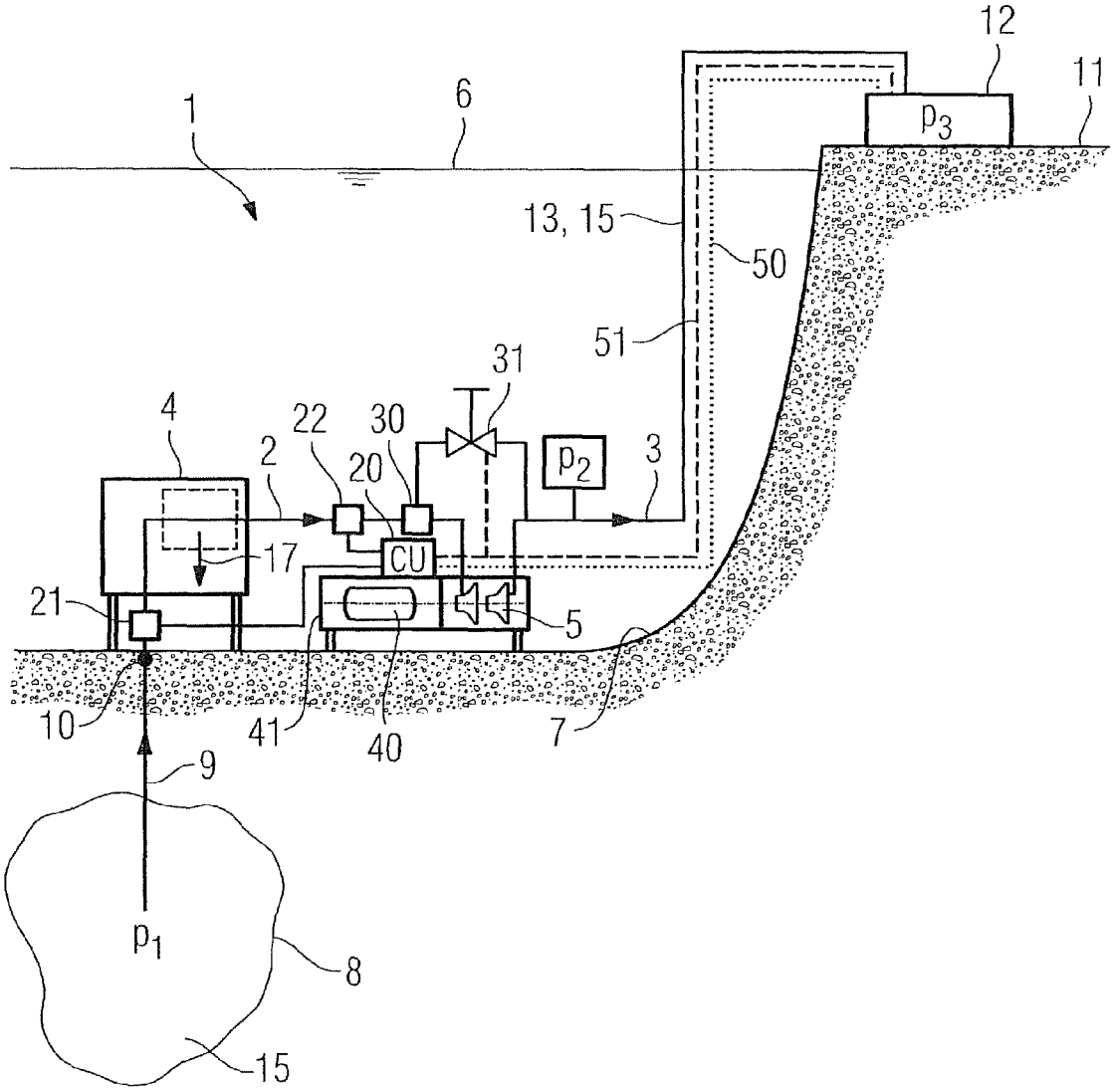
12
11
1
6
$p_3$
13, 15
50
51
31
4
22
30
2
20
$p_2$
3
17
CU
21
5
10
41
40
7
9
$p_1$
8
15

COMPRESSOR UNIT INCLUDING A DETECTION DEVICE TO IDENTIFY NON-GASEOUS FLUID IN THE SUCTION LINE

CROSS REFERENCE TO RELATED APPLICATIONS

This application is the US National Stage of International Application No. PCT/EP2009/051919, filed Feb. 18, 2009 and claims the benefit thereof. The International Application claims the benefits of European Patent Application application No. 08003399.6 EP filed Feb. 25, 2008. All of the applications are incorporated by reference herein in their entirety.

FIELD OF INVENTION

The invention relates to a compressor unit with a compressor, with a suction line and with a discharge line, with a control unit, which controls the compressor's operation and/or the operation of adjacent modules. Further the invention relates to a method to operate a compressor unit, which compressor unit is of the incipiently mentioned type.

BACKGROUND OF INVENTION

Recent developments in particular in the field of natural gas exploitation are aiming to compress natural gas below sea-level directly at the well-head. Theses developments are economically very interesting because offshore platforms involve extremely high costs for operating personal. Underwater compression of natural gas might in future make mend offshore platforms superfluous.

However, the new development goes along with enormous technical problems connected with difficult operating conditions and bad accessibility of the compression units. Major challenges are low temperatures near the freezing point, high pressure of the surrounding chemically aggressive seawater, non-purified and chemically aggressive fluid to compress, wherein the natural gas varies in the suction-pressure and carries next to foreign particles also non-gaseous fluids respectively liquids in significant amounts. Over the life-time of the well, the pressure of the natural gas to be exploited decreases significantly. According to environmental protection no media exchange between the compressor unit and the surrounding is admitted.

International patent application WO01/50024 A proposes to provide a detection device in the suction line of a compressor unit to detect for particles or amount of liquid by a density meter and to change operation of the compressor accordingly. However, this might not be sufficient since big amounts of water still can destroy the compressor when entering the impeller.

SUMMARY OF INVENTION

The focus of the invention is laid on the problem of the occurrence of high amounts of non-gaseous fluid entering the compressor. It is already known to install between the well-head and the compressor unit a separator, to get rid of non-gas fluid before entering the compressor. To avoid excessive pressure loss in the separation unit and to keep the installation effort in reasonable limits, the separator cannot be built to cope with every possible amount of non-gas fluid, which might occur. On the other hand the compressor unit might be destroyed by only one incident, during which the separator was not able to cope with the amount of non-gaseous fluid.

It is therefore one object of the invention to make the compressor unit save against high amounts of non-gaseous fluids in the suction line on the way to enter the compressor and to avoid any damage.

The object is achieved by a compressor unit according to the incipiently mentioned type, wherein in the suction line at least one detection device is provide to identify non-gaseous amounts in the fluid to be compressed on the way to enter the compressor, which detection device is connected to the control unit in a signal transmitting manner.

The installation of the detection device gives the control-unit the opportunity to react depending on the condition of the fluid in the suction line.

The detection device can be any device, which is capable to identify non-gaseous amounts in the suction line. The detection can be done for instance by an optical sensor or also by an acoustic especially ultra sonic sensor. Preferably the detection is specialized on the detection of liquids but cannot also be built to identify solid objects.

One advantageous possibility of the control unit to react upon the detection of non-gaseous amounts is to reduce the speed of operation of the compressor, when an amount of non-gas detected exceeds a certain limit. This certain limit should be below an amount, which would be capable to destroy the compressor of the compressor unit.

Another possibility, which can be provided alternatively or in addition to the speed reduction feature is the provision of a dissolving unit, which dissolves non-gaseous, especially liquid amounts on their way entering the compressor. The dissolvation is preferably initiated by the control unit, when an amount of non-gas detected exceeds a certain limit. To avoid damage, the certain limit should be below any critical amount, which might be destructible for any module involved. The dissolving unit can in particular comprise a valve and a jet respectively nozzle installed in a dissolvation chamber, wherein the valve opens the way for compressed process fluid from a higher pressure level down to the suction pressure in the dissolvation chamber, which is located in the suction line. As soon as the detection device identifies amounts of non-gaseous fluid, which are to be dissolved, the control unit opens the valve and a jet stream in the dissolvation chamber dissolves the undesirable amount of non-gas into smaller amounts, which are not harmful to the modules downstream.

One embodiment of the invention provides an electric motor driving the compressor, which is enclosed together with a compressor in a gas-tight housing.

Another embodiment of the invention provides a separator in the suction line between the well-head and the compressor, wherein a detection device can be installed upstream or downstream the separator or on both sides.

BRIEF DESCRIPTION OF THE DRAWINGS

The above mentioned attributes and other features and advantages of the invention and the manner of attaining them will become more apparent and the invention itself will be better understood by reference to the following description of the currently best mode of carrying out the invention taken in conjunction with an accompanying drawing, wherein

DETAILED DESCRIPTION OF INVENTION

FIG. 1: shows a schematic depiction of the compressor unit installed sub sea over a well-head of natural gas and comprising a suction line, a discharge line and a separator.

FIG. 1 shows a compressor unit 1 comprising a suction line 2, a discharge line 3, a separator 4 and a compressor 5 located between the suction line 2 and the discharge line 3. The compressor unit 1 installed under sea level 6 on the sea ground 7. Below the sea ground 7 is a well of natural gas 8 with a delivery line 9 leading to a well-head 10. Above sea level 6 on a ground 11 a facility 12 is installed, which is further processing the fluid 13, which is natural gas 15, delivered by the compressor 5.

The natural gas 15 is stored in the well 8 at a pressure p1, compressed by the compressor 5 up to a pressure p2 and reaches the facility 12 at a pressure p3. Between well-head 10 and the compressor 5 the separator 4 is installed to purify the natural gas 15 from foreign particles and undesirable liquids. However, it cannot be excluded that the amount of liquids respectively of non-gas amounts 17 might exceed the capacity of the separator 4 and that critical amounts are leaving the separator 4 on their way to the compressor 5, which might be destructible.

The compressor 5 is equipped with a control unit 20, which is connected with detection devices 21, 22, provided in the suction line 2. The detection devices 21, 22 detect amounts of non-gas on their way entering the compressor 5. One detection device 21 is installed directly at the well-head 10 and the other detection device 22 is installed between the separator 4 and the compressor 5. It is also possible to use only one detection device 21, 22 in either one of the positions. However, the use of two detection devices 21, 22 gives more possibilities to react if amounts of non-gas or liquids occur. In this particular example the control unit 20 lowers the speed of the compressor 5 as soon as the first detection device 21 detects an amount of non-gas exceeding a certain limit.

Between the separator 4 and the compressor 5 behind the second detection device 22 a dissolvation chamber 30 is provided, which is built to dissolve amounts of liquids on their way entering the compressor. The dissolvation is done by a jet respectively nozzle emitting a stream of natural gas from the higher pressure level p2 tapped of the discharge line 3. In the line connecting the extraction from the discharge line 3, a valve 31 is provided, which is controlled by the control unit 20. If the second detection device 22 detects a critical amount of non-gas respectively of liquid the control unit 20 initiates the opening of the valve 31 and the stream exiting the nozzle from the higher pressure level p2 in the dissolvation chamber dissolves the critical amount into harmless small amounts of non-gas entering the compressor 5.

The compressor 5 is driven by an electric motor 40, which is enclosed with the compressor 5 in a gas-tight housing 41, wherein the motor-rotor and the compressor rotor are connected to one shaft supported by not depicted magnetic bearings. A power supply line 50 and a signal line 51 connect the onshore facility 12 with the control unit 21 respectively the compression unit 1.

The invention claimed is:

1. A compressor unit including a compressor, comprising:
a suction line;
a discharge line;
a dissolving unit connected upstream from the compressor; and
a control unit controlling the compressor,
wherein a first detection device is disposed in the suction line to identify non-gaseous fluid amounts in a fluid to be compressed before entering the compressor,
wherein the first detection device is connected to the control unit in a signal transmitting manner,
wherein the dissolving unit dissolves non-gas amounts before entering the compressor using a jet stream of natural gas from a higher pressure tapped from the discharge line,
wherein the dissolving is initiated when an amount of non-gaseous fluid detected exceeds a certain limit,
wherein the compressor unit further comprises a separator disposed in the suction line which is separating non-gaseous fluid amounts from the fluid before the fluid enters the compressor,
wherein the first detection device is provided upstream the separator, and
wherein the compressor unit is disposed below sea-level on the ground near a well head of a natural as well.

2. The compressor unit as claimed in claim 1, wherein the control unit controls an operation speed of the compressor and is built in such a way that the operation speed is reduced when an amount of non-gas detected exceeds the certain limit.

3. The compressor unit as claimed in claim 1, wherein the compressor unit further comprises an electric motor which is enclosed together with the compressor in a gas-tight housing.

4. The compressor unit as claimed in claim 1, further comprising a second detection device which is provided downstream the separator.

5. The compressor unit as claimed in claim 4, wherein the second detection device is an optical sensor or an acoustic sensor.

6. A method to operate a compressor unit, comprising:
providing a detection device to detect non-gaseous fluid amounts in a fluid to be compressed;
connecting the detection device in a signal transmitting manner to a control unit;
changing an operation of a compressor or adjacent modules by the control unit as a reaction to a detection of non-gaseous fluid amounts in the fluid;
providing a dissolving unit upstream of the compressor;
initiating by the control unit a dissolvation of amounts of non-gas before entering the compressor when the detection device detects an amount of non-gas exceeding a certain limit,
wherein the compressor unit comprises the compressor, a suction line, a discharge line and the control unit, the control unit controls the operation of the compressor,
wherein the compressor unit is disposed below sea-level on the ground near a well head of a natural gas well, and
wherein the dissolvation is done using a jet stream of natural gas from a higher pressure tapped from the discharge line.

7. The method as claimed in claim 6, wherein the control unit lowers a speed of operation of the compressor when an amount of non-gaseous fluid in the suction line is detected exceeding the certain limit.

8. The method as claimed in claim 6,
wherein a valve is provided in a line connecting the dissolving unit to the discharge line, and
wherein the valve is controlled by the control unit.

9. The compressor unit as claimed in claim 1, wherein a first detection device is provided upstream of the separator and a second detection device is provided downstream of the separator.

* * * * *